US006053752A

United States Patent [19]

Longueville

[11] Patent Number: 6,053,752

[45] Date of Patent: Apr. 25, 2000

[54] ELECTRICAL CONNECTOR PAIR

[75] Inventor: Jacques Longueville, Oostkamp, Belgium

[73] Assignee: Siemens Aktiengesellschaft, Munich, Germany

[21] Appl. No.: 09/049,395

[22] Filed: Mar. 27, 1998

Related U.S. Application Data

[63] Continuation of application No. PCT/DE96/01724, Sep. 12, 1996.

[30] Foreign Application Priority Data

Sep. 27, 1995 [DE] Germany ..... 195 35 959

[51] Int. Cl.[7] ..... H01R 13/64

[52] U.S. Cl. ..... 439/247; 439/249

[58] Field of Search ..... 439/246, 247, 439/248, 249

[56] References Cited

U.S. PATENT DOCUMENTS 3,673,545 6/1972 Rundle .
4,808,115 2/1989 Norton et al. ..... 439/79
5,807,145 9/1998 Deylitz ..... 439/819

FOREIGN PATENT DOCUMENTS

0301721A1 2/1989 European Pat. Off. .
0549960A2 7/1993 European Pat. Off. .

*Primary Examiner*—Lincoln Donovan
*Attorney, Agent, or Firm*—Herbert L. Lerner; Laurence A. Greenberg; Werner H. Stemer

[57] ABSTRACT

An electrical connector pair has a first electrical connector and a second electrical connector which can be connected thereto. The first electrical connector has a multiplicity of contacting elements which can be brought into contact with contacting elements of the second electrical connector through relative movement of the two connectors in a contacting direction. The contacting elements are arranged in one or more rows extending in a row-alignment direction. The contacting elements of the electrical connectors of the pair can be brought into contact with a given amount of play in a transverse direction orthogonal to the contacting direction and to the row-alignment direction. The play is effective on either one or both sides and permits a mutual offset of the electrical connectors and is greater by a multiple than a play provided in the row-alignment direction.

21 Claims, 2 Drawing Sheets

ELECTRICAL CONNECTOR PAIR

CROSS-REFERENCE TO RELATED APPLICATION

This application is a continuation of copending international application PCT/DE96/01724, filed Sep. 12, 1996, which designated the United States.

BACKGROUND OF THE INVENTION

Field of the Invention

The present invention relates to an electrical connector pair with mutually connectible first and second electrical connectors. The first electrical connector has a multiplicity of contacting elements which are brought into contact with contacting elements of the second electrical connector through relative movement in a contacting direction. The contacting element are disposed in at least one row along a row-alignment direction.

Where a first electrical connector provided for mounting on an electric printed circuit board is to be electrically and mechanically connected (soldered) to the board by surface mounting, i.e., in an SMT process, the connector is advantageously constructed in such a way that its contacting elements and the assigned terminal devices (conventionally soldering posts, which may be angled away) are distributed on both sides of the printed circuit board and are connected to the respective surfaces of the printed circuit board sides. This is primarily due to the fact that the connecting points or soldered joints, which are to be provided next to the electrical connector in the state when it is mounted on the printed circuit board, are limited in number for practical reasons.

Such an electrical connector has become known heretofore from European patent EP 0 278 868 B1. The electrical connector described there has a central, groove-like cutout formed on its rear side which renders it possible to push the electrical connector over the edge section of an electric printed circuit board. It is thereby ensured that its contacting elements and the assigned terminal devices are distributed on both sides of the electric printed circuit board and they can thus be provided in a comparatively large overall number.

The cutout in the electrical connector is advantageously adapted to the thickness of the printed circuit board. This brings with it, however, the disadvantage that printed circuit boards of different thickness require the use of electrical connectors of different construction. Moreover, plugging an element onto the edge of a printed circuit board is an operation which cannot be carried out automatically by conventional component mounting machines for surface mounting.

That problem could be solved, as is disclosed in European patent publication EP 0 360 625 A2, by constructing the electrical connector not in a single piece but in two pieces. It is possible for one connector element to be arranged on one side of the printed circuit board, and for the other connector element to be arranged independently thereof on the opposite side of the printed circuit board.

However, in that configuration the electrical connector is relatively sensitive to mechanical loads. Specifically, if the positioning, the alignment, and/or the dimensions of the first electrical connector, and/or of the second electrical connector, which is to be brought into or is in contact therewith, are not accurately tailored to one another, it is possible that when the two connectors are being brought into contact or are in contact with one another, forces may act on the first electrical connector which, because the SMT connecting points can be loaded only relatively weakly, effect, or at least promote, detachment or tearing of the connector from the printed circuit board.

SUMMARY OF THE INVENTION

It is accordingly an object of the invention to provide an electrical connector pair, which overcomes the above-mentioned disadvantages of the prior art devices and methods of this general type and, even where one or both of the electrical connectors are surface mounted on arbitrarily constructed electric printed circuit boards, the connector pair can ensure a reliably and permanently firm and secure connection.

With the foregoing and other objects in view there is provided, in accordance with the invention, an electrical connector pair, comprising:

a first electrical connector having a multiplicity of contacting elements disposed in at least one row extending in a row-alignment direction;

a second electrical connector having contacting elements to be connected to the contacting elements of the first electrical connector through relative movement of the first and second electrical connectors in a contacting direction;

the contacting elements of the first and second electrical connectors being constructed such that the contacting elements may be brought into mutual contact within a given play in a transverse direction orthogonal to the contacting direction and orthogonal to the row-alignment direction, the given play being effective on one or both sides of the transverse direction and permitting a mutual offset of the electrical connectors greater by a multiple than a play along the row-alignment direction.

In other words, the mutually assigned contacting elements of the electrical connectors are constructed in such a way that the connectors can be brought into contact in a transverse direction extending perpendicular to the contacting direction and in a transverse direction extending perpendicular to the row-alignment direction within an increased freedom of play, either on one or on both sides. This permits a mutual offset of the electrical connectors and the play in the transverse direction is greater by a multiple than a play provided in the row-alignment direction.

The primary advantage of the invention is attained in that the elements can be brought into contact and thus also remain in contact not, for example, only at a location which is more or less punctiform, but over a comparatively large region which is greatly widened in the transverse direction.

As a result of this feature, when the electrical connectors are moved into mutual contact and/or when they are in contact, no transverse forces at all, or at most relatively weak ones, act in the transverse direction of the first electrical connector. This is specifically advantageous when the positioning, the alignment, and/or the dimensions of the first electrical connector and/or of the second electrical connector deviate substantially from the desired values. High degrees of tolerance are thus acceptable.

The reduction in, or the complete elimination of forces acting in the transverse direction of the first electrical connector proves as a rule (but not exclusively) to be particularly effective when the connector is mounted lying on the corresponding electric printed circuit board, that is to say the contacting direction extends parallel to the printed circuit board surface, and when, in this case, the terminal region containing the connecting points between the first electrical connector and the electric printed circuit board extends on the printed circuit board along one side of the electrical connector which is opposite the side of the first electrical connector, which is designated below as the end face, at which the contact is produced with the second electrical connector. Such a configuration of the first electrical connector on the electric printed circuit board is, for example, customary in the case of printed circuit board connectors which permit a first printed circuit board (for example a module board) to be plugged onto a second printed circuit board (for example backplane).

Where a first electrical connector is mounted in such a way, transverse forces acts on the connecting points as a torsional and/or tensile force which, because of the fact that the first electrical connector acts as a relatively long lever, can become quite substantial in the terminal region. Such forces may quickly effect a "peeling" of the SMT connecting points from the printed circuit board.

In addition, in such a configuration of the first electrical connector on the electric printed circuit board, the tolerances, causing the force in the transverse direction of the first electrical connector and thus causing the torsional and/or tensile force acting on the connecting points, in the positioning, the alignment and/or the dimensions of the first electrical connector and/or of the second electrical connector are added together in a particularly unfavorable way, specifically when bipartite electrical connectors are involved whose elements are mounted independently of one another on opposite surfaces of the printed circuit board (first electrical connector) and/or are mounted, in accordance with the desired arrangement of the (first) electrical connector with which contact is to be made, spaced apart on one and the same surface of the corresponding printed circuit board (second electrical connector).

The tolerances causing the transverse force or the torsional and/or tensile forces in this case include:

- tolerances in the thickness and the curvature of the printed circuit board(s);
- tolerances in the gap respectively forming between the electrical connector and printed circuit board;
- tolerances in the positions and/or mutual spacings of the contacting elements and/or in the contact openings in the housing of the first electrical connector and of the second electrical connector; and
- tolerances in the positioning and alignment of the first electrical connector and of the second electrical connector on the respective printed circuit boards.

Due to the fact that the contacting elements are designed for large transverse offsets, even the sum of the tolerances and, moreover, also comparable effects arising from making contact improperly (for example in an oblique or laterally offset fashion) can be eliminated to such an extent that torsional and/or tensile forces cannot be produced, or at most put only negligible stress on the connecting points.

The electrical connector pair according to the invention therefore permits that even in the case of surface mounting on arbitrarily constructed electric printed circuit boards of one or both of the electrical connectors to be brought into contact. The connector pair ensures a reliably and permanently firm and secure connection between the electrical connectors.

Moreover, the enlarged structure of the contacting elements only in the transverse direction which is to be observed for reasons of strength and stability, permits the contacting elements to be arranged in the row-alignment direction without a change in density or, if appropriate, even with increased density.

In accordance with an added feature of the invention, the play in the transverse direction is about twice to about four times the play in the row-alignment direction.

In accordance with an additional feature of the invention, at least one of the first electrical connector and the second electrical connector is a printed circuit board connector with high contact density and mountable on a printed circuit board.

In accordance with another feature of the invention, there are provided terminal devices for connecting the contacting elements of the first and/or second electrical connectors to a respective printed circuit board. The terminal devices are adapted to be connected to the printed circuit board by an SMT process. Specifically, the terminal devices may be angled-away soldering posts soldered to respective terminal regions on the printed circuit boards spaced apart from the respective the connector.

In accordance with a further feature of the invention, the first electrical connector includes a connector housing enclosing and/or holding the contacting elements. The housing has an end face formed with contact openings through which the contacting elements of the first electrical connector are contacted with the contacting elements of the second electrical connector.

In accordance with again an added feature of the invention, in agreement with predetermined dimensions of the mutually assigned contacting elements and of the play to be provided, the contact openings are wider in the transverse direction perpendicular to the contacting direction and to the row-alignment direction than in the row-alignment direction.

In accordance with again an additional feature of the invention, the contacting elements of the first electrical connector are contact springs of a plug-in connector system.

In accordance with again another feature of the invention, the first electrical connector is mounted on the printed circuit board, and the row-alignment direction is substantially parallel to a surface of the printed circuit board on which the connector is mounted. The contacting direction, in another feature of the invention, is substantially parallel to the surface of the printed circuit board. In addition, the transverse direction may extend substantially perpendicularly to the surface of the printed circuit board.

In accordance with again a further feature of the invention, the second electrical connector is mounted on a printed circuit board and the contacting direction is substantially perpendicular to the surface of the printed circuit board. The transverse direction may extend substantially parallel to the surface of the printed circuit board.

In accordance with yet an added feature of the invention, a number of the contacting elements along each row is greater than a number of rows.

In accordance with yet an additional feature of the invention, the terminal region on the printed circuit board is disposed on a side of the housing opposite the end face thereof.

In accordance with yet another feature of the invention, there is provided a holding element opposite the terminal region, the holding element respectively connecting one of the first electrical connector and the second electrical connector to the respective electric printed circuit board. Preferably, the holding element is adapted to be connected to the respective printed circuit board with an SMT process.

In accordance with yet a further feature of the invention, the first electrical connector is a split connector formed of two mutually independent halves respectively mounted on an upper surface of the printed circuit board and on a lower surface of the printed circuit board, the mutually independent halves of the first electrical connector forming a unitary connector sandwiching the printed circuit board therebetween.

In accordance with yet again a further feature of the invention, the second electrical connector is also a split connector formed of two mutually independent halves. These two halves, however, are mounted on the same surface of the second printed circuit board in accordance with an arrangement of the first electrical connector. The mutually independent halves of the second electrical connector are mutually spaced apart by a distance defined by the first electrical connector and the first printed circuit board.

In accordance with a concomitant feature of the invention, the first electrical connector and/or the second electrical connector is assembled from a multiplicity of butt-mounted modules.

Other features which are considered as characteristic for the invention are set forth in the appended claims.

Although the invention is illustrated and described herein as embodied in an electrical connector pair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
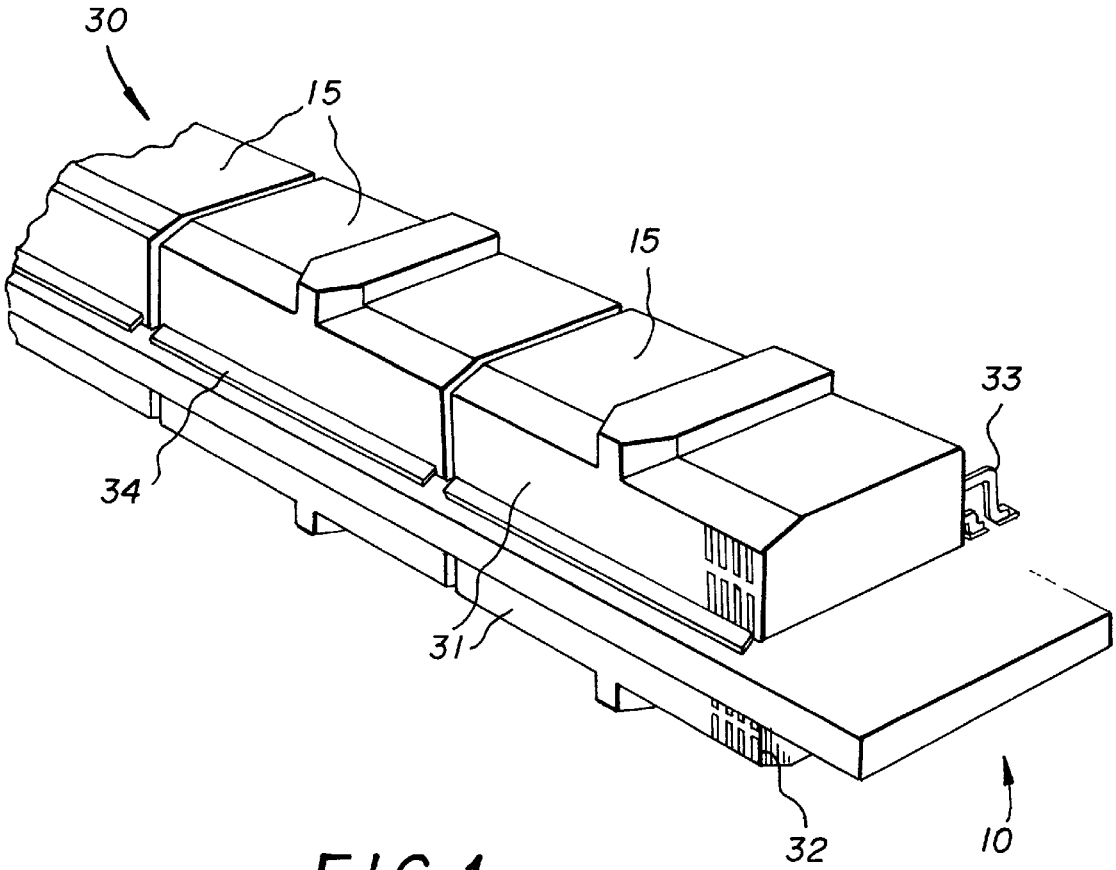
FIG. 1 is a perspective view of a first electrical connector mounted on a partially illustrated printed circuit board.

In the best mode exemplary embodiment described herein, the first and second electrical connectors are printed circuit board plug-in connectors mounted on respective printed circuit boards.

Referring now to the figures of the drawing in detail, the printed circuit boards are a module board 10 and a backplane 20. The first electrical connector is a module plug-in connector 30, and the second electrical connector is a backplane plug-in connector 40. Electrical contact between the connectors 30, 40, and thus between the two circuit boards 10, 20 is effected when the generally male connector 40 is plugged into the generally female connector 30.

The module plug-in connector 30 and the backplane plug-in connector 40 represent the electrical connector pair according to the invention.

The module plug-in connector 30 is arranged along a front edge 11 of the module board 10 in such a way that when the module board 10 is plugged onto the surface of the backplane 20 it can be brought into contact with the backplane plug-in connector 40 mounted thereon.

With specific reference to FIG. 1, the module plug-in connector 30 comprises two identically constructed halves, one of the halves being placed flush onto a top surface 12*a* of the module board 10, and the other half being placed in a similar way onto an opposite lower surface 12*b* of the module board 10. The two halves are completely independent of one another in the non-mounted state; in the mounted state, they form a unit together with the module board 10, which is sandwiched in between them.

Figure 2:
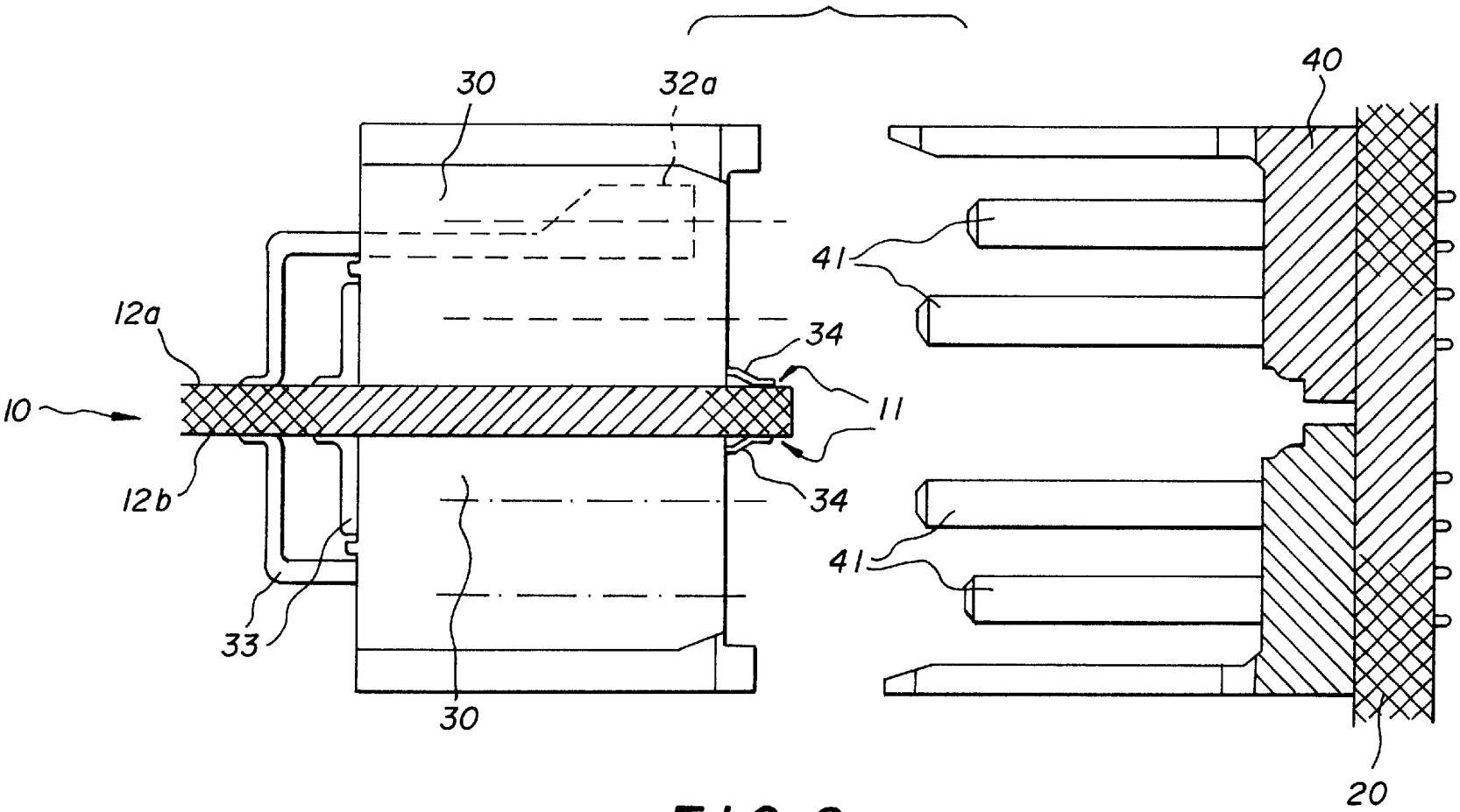
FIG. 2 is a sectional view of the first electrical connector of FIG. 1, and of a second electrical connector mounted on a partially shown backplane.

With specific reference to the right-hand side of FIG. 2, the backplane plug-in connector 40 provided on the backplane 20 likewise comprises two halves. The halves are parallel to one another with a spacing corresponding to the thickness of the module board 10 or in accordance with the desired arrangement of the module plug-in connector 30 on the surface of the backplane 20 facing the module board 10 in the plugged state.

Again with reference to FIG. 1, the respective halves of the module plug-in connector 30 are assembled in their longitudinal direction from butt-mounted (abutment mounted), relatively short plug-in connector modules 15. The size of the respective plug-in connector modules 15 is dimensioned such that the latter fit into conventional strip packages and can be processed automatically with conventional component mounting machines. The same holds true for the backplane plug-in connector 40.

The module plug-in connector 30 is mounted lying on the module board 10. In other words, in the state in which the module plug-in connector 30 is mounted on the module board 10, the face of the plug via which the module plug-in connector 30 can be brought into contact with the backplane plug-in connector 40 is constructed in a lateral outer surface, facing the front edge 11 of the module board 10, of the module plug-in connector 30, that is to say in the end face 31 facing the backplane 20 in the state in which the module plug-in connector 30 is plugged onto the backplane 20. In the state in which the module plug-in connector 30 is mounted on the module board 10, the end face 31 is substantially vertical on the upper surface 12*a* and the lower surface 12*b* of the module board 10.

As indicated in FIG. 1, the end face 31 has a multiplicity of contact openings 32, behind which respective contacting elements in the form of diagrammatically indicated contact springs 32*a* are located. When the module board 10 is plugged onto the backplane 20 in a substantially vertical relative orientation, that is to say the module board 10 and the backplane 20 move relative to each other in a contacting direction (parallel to the module board and perpendicular to the backplane), contacting elements in the form of contact pins 41 of the connector 40 come into contact with the contact springs through the contact openings 32.

The contact openings 32 and the contact springs assigned thereto are arranged in at least one row extending in a row-alignment direction. The row-alignment direction of the illustrated exemplary embodiment extend parallel to the surface of the module board 10 and perpendicular to the contacting direction. If a plurality of rows are provided, the contact openings are formed in rows lying one above another, as shown in the figures. The number of elements per row is, however, greater as a rule in this case than the number of the rows.

The module plug-in connector 30 is connected to the module board 10 by surface mounting in an SMT process. For this purpose, the connector 30 is provided with angled-away soldering posts 33 which project from the module plug-in connector 30 on a rear side opposite the end face 31. The soldering posts 33 are soldered to pads or tracks on a terminal region of the module board 10 adjacent the plug-in connector 30.

It will be appreciated by those familiar with surface mounted connections formed with an SMT process that those connections are less capable of being mechanically stress loaded. Special attention must therefore be paid to the structural design of such devices.

For the purpose of preventing such connections from being loosened or destroyed, the present exemplary embodiment provides for the contact openings 32 and the contact springs (i.e., those segments of the contact springs which contact the pins 41) situated behind the contact openings to be extended in a transverse direction perpendicular to the contacting direction and in a transverse direction extending perpendicular to the row-alignment direction. The respective dimensions, arrangements and configurations of the mutually assigned contact springs of the first electrical connector and contact pins of the second electrical connector are selected according to the invention such a way that the latter can be brought into contact in a transverse direction orthogonal to the contacting direction and in a transverse direction orthogonal to the row-alignment direction. This is done with play on one or both sides which permits a mutual offset of the electrical connectors and which is greater by a multiple as compared to the freedom of play provided in the row-alignment direction. The play in the transverse direction should be approximately twice the play in the row-alignment direction or more, but can, of course, also be smaller. In the preferred configuration, transverse play is approximately two to four times the play in the row-alignment direction.

The contact springs of the module plug-in connector 30, and the respectively assigned contact pins 41 (i.e., contact blades 41) of the backplane plug-in connector 40 can therefore be brought and held in contact electrically and mechanically within a relatively large area. They are thereby connected at each point in an equally effective fashion (without resistance). Such a configuration of the contacting elements renders it possible, when the contact springs and contact pins are brought into contact, to compensate for a mutual offset (as a consequence of non-centered plug-in movement, inexact mounting of the plug-in connectors or plug-in connector modules on the respective printed circuit boards, or of manufacturing tolerances of the individual elements), without the increased danger of forces acting on the respective plugin connectors which can result in a loosening of the relatively sensitive connections between the plug-in connector and the printed circuit board. In particular, the invention reliably prevents any forces which would result on the end face of the module plug-in connector which act in the transverse direction; those forces, at the connecting points between the module plug-in connector and the module board, act as torsional, shearing, and/or tensile forces against which those connecting points are particularly sensitive.

As an alternative or in addition thereto, the module plug-in connector 30 can be provided on its side opposite the terminal region of the module board 10 in the state in which the plugin connector is mounted on the module board with a holding element which can be firmly connected to the module board 1. As shown in the figures, such a holding element can, for example, be formed by a holding plate 34 which is provided on the end face 31, preferably extends essentially over the entire length of the module plug-in connector 30 or of the respective plug-in connector modules 15, and can be soldered to the module plug-in connector at the front edge 11 (again, preferably, with an SMT process).

The embodiment of the invention described in the foregoing with reference to the drawing figures deals with a printed circuit board plug-in connector arrangement. However, the invention is not limited to that embodiment. Rather, the invention can be used with electrical connectors of any type, the point being that with virtually all types of electrical connector it would be possible, when the latter are being brought into contact or contact has been closed, for there to be produced forces which disadvantageously influence the connectors and/or the connection and which can be avoided by configuring the connector pair according to the invention.

In the exemplary embodiment described, the first electrical connector (module plug-in connector 30) is mounted lying on a printed circuit board (module board 10). The invention is not limited to this. Rather, it is also possible to apply the invention usefully in a corresponding way with electrical connectors which are or can be mounted standing or in some other way on a printed circuit board, because here, as well, when the electrical connector is brought into contact and/or unplugged and/or is in the state of contact with a corresponding mating component, forces acting on the electrical connector can be produced which, for their part, act again on the connecting points between electrical connector and printed circuit board as torsional and/or tensile forces. The present invention avoids these undesirable forces.

I claim:

1. An electrical connector pair, comprising:

a first electrical connector having a multiplicity of contacting elements disposed in at least one row extending in given direction having a predetermined play;

a second electrical connector having contacting elements connected to said contacting elements of said first electrical connector through a movement of said first and second electrical connectors in a direction towards each other;

said contacting elements of said first and second electrical connectors being constructed for bringing said contacting elements into mutual contact within a given play in a transverse direction orthogonal to the direction of said movement and orthogonal to the given direction, the given play being effective at least at one side of the transverse direction and permitting a mutual offset of said electrical connectors greater by a multiple than said predetermined play.

2. The electrical connector pair according to claim 1, wherein the play in the transverse direction is approximately two to four times the play in the row-alignment direction.

3. The electrical connector pair according to claim 1, wherein at least one of said first electrical connector and said second electrical connector is a printed circuit board connector with high contact density and mountable on a printed circuit board.

4. The electrical connector pair according to claim 3, which comprises terminal devices for connecting said contacting elements of said at least one of said first and second electrical connectors to a respective printed circuit board, said terminal devices being adapted to be connected to the printed circuit board by an Surface Mounted Technology process.

5. The electrical connector pair according to claim 1, wherein said first electrical connector includes a connector housing enclosing said contacting elements, said housing having an end face formed with contact openings through which said contacting elements of said first electrical connector are contacted with said contacting elements of said second electrical connector.

6. The electrical connector pair according to claim 5, wherein, in agreement with predetermined dimensions of the mutually assigned contacting elements and of the play to be provided, said contact openings are wider in the transverse direction perpendicular to the contacting direction and to the row-alignment direction than in the row-alignment direction.

7. The electrical connector pair according to claim 1, wherein said contacting elements of said first electrical connector are contact springs of a plug-in connector system.

8. The electrical connector pair according to claim 3, wherein the printed circuit board has a surface and, when said first electrical connector is mounted on the printed circuit board, the row-alignment direction is substantially parallel to the surface of the printed circuit board.

9. The electrical connector pair according to claim 3, wherein the printed circuit board has a surface and, when said first electrical connector is mounted on the printed circuit board, the contacting direction is substantially parallel to the surface of the printed circuit board.

10. The electrical connector pair according to claim 9, wherein, when the first electrical connector is mounted on the printed circuit board, the transverse direction extends substantially perpendicularly to the surface of the printed circuit board.

11. The electrical connector pair according to claim 3, wherein the printed circuit board has a surface and, when said second electrical connector is mounted on the printed circuit board, the contacting direction is substantially perpendicular to the surface of the printed circuit board.

12. The electrical connector pair according to claim 11, wherein, when the second electrical connector is mounted on the printed circuit board, the transverse direction extends substantially parallel to the surface of the printed circuit board.

13. The electrical connector pair according to claim 11, wherein a number of said contacting elements along each row is greater than a number of rows.

14. The electrical connector pair according to claim 3, wherein, when said first electrical connector is mounted on the respective printed circuit board, a plurality of contacting element rows extend adjacent one another.

15. The electrical connector pair according to claim 4, wherein said terminal devices are angled-away soldering posts soldered to respective terminal regions on the printed circuit boards spaced apart from the respective said connector.

16. The electrical connector pair according to claim 15, wherein said first electrical connector includes a connector housing enclosing said contacting elements, said housing having an end face formed with contact openings through which said contacting elements of said first electrical connector are contacted with said contacting elements of said second electrical connector, the terminal region on the printed circuit board being disposed on a side of said housing opposite said end face.

17. The electrical connector pair according to claim 15, which comprises a holding element opposite the terminal region, said holding element respectively connecting one of said first electrical connector and said second electrical connector to the respective electric printed circuit board.

18. The electrical connector pair according to claim 17, wherein said holding element is adapted to be connected to the respective printed circuit board with an SMT process.

19. The electrical connector pair according to claim 3, wherein said first electrical connector is a split connector formed of two mutually independent halves respectively mounted on an upper surface of the printed circuit board and on a lower surface of the printed circuit board, said mutually independent halves of said first electrical connector forming a unitary connector sandwiching the printed circuit board therebetween.

20. The electrical connector pair according to claim 3, wherein said second electrical connector is a split connector formed of two mutually independent halves mounted on a top surface of the second printed circuit board in accordance with an arrangement of said first electrical connector, said mutually independent halves of said second electrical connector being mutually spaced apart by a distance defined by said first electrical connector and the first printed circuit board.

21. The electrical connector pair according to claim 1, wherein at least one of said first electrical connector and said second electrical connector are assembled from a multiplicity of butt-mounted modules.

* * * * *